United States Patent [19]

Rowland

[11] 4,289,673

[45] Sep. 15, 1981

[54] PROCESS FOR PRODUCING DURABLE-PRESS COTTON FABRICS WITH IMPROVED BALANCES OF TEXTILE PROPERTIES

[75] Inventor: Stanley P. Rowland, New Orleans, La.

[73] Assignee: The United States of America as represented by the Secretary of Agriculture, Washington, D.C.

[21] Appl. No.: 118,949

[22] Filed: Feb. 6, 1980

Related U.S. Application Data

[62] Division of Ser. No. 8,130, Jan. 31, 1979.

[51] Int. Cl.[3] ..... C08L 61/22; C08L 61/28; C08L 61/32

[52] U.S. Cl. ..... 260/29.4 R; 252/8.8

[58] Field of Search ..... 240/29.4 R

[56] References Cited

U.S. PATENT DOCUMENTS

| | | | |
|---|---|---|---|
| 2,096,181 | 10/1937 | Jahrstorfer et al. | 8/184 |
| 2,992,138 | 7/1961 | Bacon | 260/29.4 R |
| 3,006,879 | 10/1961 | Ryan et al. | 8/183 |
| 3,138,802 | 6/1964 | Getchell | 427/342 |
| 3,311,496 | 3/1967 | Van Loo | 8/184 |
| 3,402,988 | 9/1968 | Reeves et al. | 8/183 |
| 3,441,366 | 4/1969 | Pierce | 8/183 |
| 3,526,474 | 9/1970 | Reeves et al. | 8/183 |
| 3,606,992 | 9/1971 | Aldrich | 8/183 |
| 3,622,261 | 11/1971 | Cotton et al. | 8/187 |
| 3,634,019 | 1/1972 | Beaumont et al. | 8/184 |
| 3,656,885 | 4/1972 | Gagliardi | 8/184 |
| 3,807,952 | 4/1974 | Lachenauer | 8/186 |
| 3,827,994 | 8/1974 | Cicone et al. | 260/29.4 R |
| 3,877,872 | 4/1975 | Vail et al. | 8/183 |
| 3,933,426 | 1/1976 | Martini et al. | 8/183 |
| 3,970,424 | 7/1976 | Kullman et al. | 8/185 |
| 4,052,158 | 10/1977 | Weil | 8/120 |

OTHER PUBLICATIONS

Reinhardt et al. Book of Papers of AATCC Tech. Conf. 10/1975.

Valko et al. Text Research Jour. Apr. 1967 pp. 253–263.

*Primary Examiner*—Joseph L. Schofer
*Assistant Examiner*—Maria Parrish Tungo
*Attorney, Agent, or Firm*—M. Howard Silverstein; David G. McConnell; Raymond C. Von Bodungen

[57] ABSTRACT

Improved levels of abrasion resistance, breaking strength are coupled with high levels of resilience, as measured by durable-press appearance rating and wrinkle recovery angles, by a process in which cotton or cotton-containing fabric is treated with polyfunctional N-methylol reagents, a Brϕnsted acidic catalyst or Brϕnsted acid-generating catalyst and selected phosphate salts. The fabric is impregnated with these and supplementary agents as desired and cured by conventional methods.

1 Claim, No Drawings

PROCESS FOR PRODUCING DURABLE-PRESS COTTON FABRICS WITH IMPROVED BALANCES OF TEXTILE PROPERTIES

CROSS REFERENCE TO RELATED APPLICATIONS

This is a division of application Ser. No. 8,130, filed 1/31/79. This application is related to copending application Ser. No. 8,129, filed Jan. 31, 1979, now U.S. Pat. No. 4,255,149.

BACKGROUND OF THE INVENTION (1) Field of the Invention

This invention relates to improving the physical properties of cotton cellulose containing textiles. More specifically this invention relates to products and the process of imparting improved balances of textile properties wherein improved levels of abrasion resistance, breaking strength and tearing strength are combined with high levels of resilience. This superior balance of textile properties is achieved by modification of a conventional chemical treatment of cellulosic textiles.

(2) Description of the Prior Art

It is well known to impart durable wrinkle resistance to cellulosic fabric such as cotton fabric by impregnation with an aqueous solution of a suitable thermo-setting resin precondensate or a cellulose crosslinking agent, usually accompanied by an appropriate catalyst, and eventually curing the impregnated fabric. Such treatment has been effective in improving the wrinkle resistance and the shape holding properties of cotton fabrics and has resulted in greatly increased demand for "Easy-Care", "Wash-And-Wear", "Permanent-Press", and "Durable-Press" cotton fabrics, that are desired in today's textile market.

A variety of processes has been developed and used for improving wrinkle resistance or wrinkle recovery of fabrics and garments. These processes are known in general as pad-dry-cure chemical resin treatments, wherein one or more reagents are applied to the fabric through padding, and the fabrics are partially dried before the resin is cured.

The conventional thermo-setting chemical or resin systems (either post-cured or precured) result in embrittlement and reduction of mobility of the microstructural units of cellulosic fibers to such an extent that tearing strength, breaking strength and abrasion resistance are seriously impaired. Tearing strength is often reduced by 50%, breaking strength by 50–60%, and abrasion resistance by 75–85%.

Over the last several years, considerable research has been conducted to find ways of overcoming this problem without compromising the wash-wear or durable-press performance of the fabric. Many variations of pad-dry-cure processing have been developed in attempts to solve the problem. These include processes involving a multistage padding and curing, processes involving a pad and wet-fixation prior to cure, and processes involving polymeric additives. The results achieved through all of these processes have been marginal, and the processes have often been found to be crumblesome and expensive.

A particularly promising approach to the production of easy-care, durable-press fabric has involved a wet fixation of resin-forming, crease-proofing agents such as formaldehyde-melamine precondensate, as disclosed in Textile Research Journal 37, 70 (1967) and in U.S. Pat. No. 3,138,802. In this type of process the fiber system such as cotton fabric is protected against an excess strength loss by fixation of a suitable resin forming and crease proofing agent within the fibers while they are wet and swollen. In the laboratory process the fabric, padded with a solution of reagents at pH=2 is heated in a moist atmosphere to achieve fixation of the N-methylol reagents. Part of the resin in contact with the cotton is firmly fixed in the cotton fibers and the fabric at this stage; after rinsing and introduction of a catalyst and softener, the fabric can be cured immediately or stored prior to cure at elevated temperature. Wet fixation processes have generally been cumbersome, or have required special processing equipment.

The use of nonreactive or co-reactive additives for the purposes of obtaining improved abrasion resistance on durable-press fabrics is discussed in Textile Research Journal 37, 253 (1967). This type of approach is exemplified in U.S. Pat. No. 3,877,872 which calls for the inclusion of triethylene glycol dimethyl ether in a conventional reagent bath consisting of methylolated methylolmelamine and a cross-linking agent, such as dimethyloldihydroxyethyleneurea and a catalyst, such as zinc nitrate or magnesium chloride. This same patent illustrates also, the introduction of an aqueous emulsion of polyurethanes into fabric in a separate step to develop a fiber coating that enhances abrasion resistance. In general, the benefits are less than desired from such modifications of conventional cross-linking treatments.

In U.S. Pat. No. 3,606,992 there is described a method for treating cotton-containing fabric for obtaining improved wrinkle-resistance and improved abrasion resistance which involves padding the fabric through a resin finishing bath containing a mixture of a conventional thermo-setting resin in combination with a latex emulsion prior to a subsequent drying step, and a final curing at elevated temperature. In this case the additive is a synthetic rubber latex, which consists of a carboxy-modified butadiene-styrene copolymer in emulsion form. This preformed polymer undergoes some reaction with the resin forming reagents to produce a coating on fabric, yarn and fiber surfaces.

U.S. Pat. No. 3,311,496 describes a process that involves pretreatment of fabric with hardenable aminoplasts by the wet steam process before treatment with crease-proofing hardenable aminoplasts. At a given level of wrinkle recovery, the tensile strength of the product is significantly higher than that of the unpretreated fabric. U.S. Pat. No. 2,992,138 teaches to overcome adverse effects upon tensile strength of fabrics caused by zinc nitrate catalyst employed with dimethylolethyleneurea by introducing an alkali metal acetate into the reagent mixture. U.S. Pat. No. 3,402,988 achieves improved abrasion resistance and other properties by first impregnating fabric with conventional wash-wear formulations, and second applying a catalyst deactivator on the top and bottom of the fabric, so that superior properties are retained in the surface area. According to U.S. Pat. No. 3,634,019 high strength losses in cellulosic fabrics when treated with crease proofing agents to produce durable-press properties are avoided by eliminating a major part of the usual acidic catalyst and adding an amount of zinc or aluminium acetate.

In U.S. Pat. No. 3,807,952 there is described, a method for improving abrasion resistance in crosslinked cellulosic fibers which amounts to introducing salt additives to the conventional reagent system. U.S. Pat. No. 3,827,994 refers to imparting abrasion resistance and permanent press properties to cellulosic materials by employing N-methylollactamide in conjunction with other N-methylol reagents. U.S. Pat. No. 3,526,474 describes a process for imparting abrasion resistance and wrinkle resistance and durable-press properties to cellulosic fibers by first applying the N-methylol reagent and subjecting it to curing conditions in the presence of a so-called polymerization catalyst and later impregnating the treated fabric with latent acid catalyst, drying and finally curing. U.S. Pat. No. 3,656,885 achieves improvement in wear resistance of cotton fabrics in wash-wear or durable-press garments by sequentially seperate steps of swelling, substitution, and crosslinking of fabric and, more specifically applying to cotton pairs of monofunctional and polyfunctional reactive swelling agents.

In the above-cited prior art and conventional processes for development of easy-care or durable-press properties in cotton fabrics, the N-methylol resins reduce the hydrophilic characteristics of the original cotton fiber, and this is further accentuated and aggravated by introduction of supplementary additives into the reagent system. The result is that the hydrophilic characteristics of the cotton are further reduced. Since the cotton fiber is unique among major textile fibers for apparel in its hydrophilic characteristics, it is undesirable that these be lost; in general, reduction of hydrophilic characteristics of cotton results in decreased moisture regain, decreased water imbibition, and decreased comfort to a wearer.

SUMMARY OF THE INVENTION

This invention provides a chemical process for imparting to cellulosic textiles durable, permanent-press properties and wrinkle resistance together with retention of improved levels of abrasion resistance, strength, and hydrophilic characteristics.

These qualities are achieved by applying to the cellulosic textile an aqueous solution containing three primary ingredients, two of which are conventional and one of which is introduced to provide the special effects realized in this invention. The first ingredient consists of at least one water-soluble crosslink-forming compound possessing two or more reactive methylol groups. The second ingredient is a Brϕnsted acid catalyst or a Brϕnsted acid-generating metal salt. The third and critical component in this invention is a phosphate salt or a mixture of phosphate salts. Supplementary agents may be added. After impregnation of the textile with a solution, primarily aqueous, consisting of at least the three forementioned ingredients, the fabric may be dried prior to exposure to elevated temperature: but in any case, it is subjected to a temperature appropriate to activate the acid catalyst or acid-generating catalyst. Following the cure, the textile may be utilized as such or it may be subjected to rinsing or laundering prior to usage.

Accordingly, a primary object of the present invention is to provide a process for improving durable press appearance rating, wrinkle resistance, and smooth drying characteristics of cellulosic fiber containing materials which process substantially prevents or alleviates some of the problems of the prior art discussed above.

Another object of the present invention is to provide a process for achieving a favorable or attractive balance among resilience (as evident in durable press appearance rating, wrinkle resistance and easy-care properties) and durability of fabric (as evident in abrasion resistance, breaking strength, and tearing strength) and comfort (as evident in hydrophilic characteristics such as moisture regain and water of imbibition of fabric).

DESCRIPTION OF THE PREFERRED EMBODIMENTS

The present invention is useful for treating various natural or artificial cellulosic fibers alone or as mixtures with each other in various proportions or as mixtures with other fibers. They include natural cellulosic fibers such as cotton, linen and hemp, and in addition, the regenerated artificial cellulosic fibers such as the various types of rayons. Other fibers may be used in blends with one or more of the above mentioned cellulosic fibers; these supplementary blend fibers may be wool, silk, cellulose acetate, polyamides, polyesters, acrylics, polyurethanes, and vinyl based fibers. The preferred percentages of cellulosic fibers are upward from 30%.

The material may be knit, woven, nonwoven, or otherwise constructed fabric or the invention may be applied to fibers or yarns before they are converted into the complex structures.

We have now discovered that such cellulosic fiber-containing materials may be impregnated with aqueous solutions of conventional methylol reagents, Brϕnsted acid catalyst or Brϕnsted acid-generating catalyst, a phosphate salt or a mixture of phosphate salts, and cured with or without prior drying, and that the resulting fiberous or textile products have high resilience (wrinkle recovery angles, durable press rating, and smooth drying properties), high retentions of abrasion resistance and strength, and attractive levels of hydrophilic characteristics. The essence of this discovery may be stated as following: Durable-press fabrics characterized by improved levels of retentions of abrasion resistance and strength and by elevated hydrophilic characteristics may be produced by reacting cellulosic textiles with methylol reagents in the presence of a Brϕnsted acid or acid-generating catalyst and selected phosphate salts or mixtures of phosphate salts. In this regard, the foregoing terms may be defined as follows: Durable-press (as applied to cellulosic fabric) is defined as high wrinkle resistance, good smooth drying appearance, and excellent retention of shape as measured primarily by wrinkle recovery angle and durable-press appearance rating. Durable-press properties are generally imparted to cellulosic fabrics by reactions that form crosslinks in the cellulosic fibers. Retention of strength is measured on experimentally-treated samples and compared to strength of the unmodified fabric; in this connection breaking strength and tearing strength are measured in the conventional manner. Retention of abrasion resistance also involves a comparison of results obtained on the experimentally-treated fabric relative to those obtained on the initial unmodified fabric; tests appropriate for the estimation of abrasion resistance are the Stoll flex abrasion resistance test and the Accelerotor weight loss test. Hydrophilic characteristics of textile fibers are readily assessed in terms of moisture regain and water of imbibition which reflect equilibria between the textile or fiber in the textile and vapor phase moisture, on the one hand, or liquid water, on the other hand.

In the process of the invention, the methylol reagent may serve the usual function, i.e., that of undergoing etherification reactions with the cellulosic substrate with formation of crosslinks and development of resilience. The acid or acid-generating catalysts simply catalyze this reaction between the methylol reagent and hydroxyl groups in the cellulosic substrate. The phosphate salt or mixtures of phosphate salts serve, in some manner, to influence the chemical reaction or the physical aspects of this reaction in the fabric, the yarn, and the fiber; it is believed that the effect of the phosphate salts is exerted within the microstructure of the fiber and that this effect is very likely chemical and physical. The chemical contributions from the phosphate salts could be that of buffering the chemical reaction, and this is not an unlikely possibility. On the other hand, it is not completely consistent or understandable in terms of fact that a dihydrogen phosphate salt buffers at a different pH than monohydrogen phosphate whereas both of these, individually or in mixtures, are effective in improving the balance of properties in the chemically modified fabrics. Furthermore, it appears pertinent that other buffering agents, when employed in place of phosphate salts do not provide the same beneficial effects; this is the case, for example, when salts or acetic acid or boric acid are employed in the place of salts of phosphoric acids. That the effect of the phosphate is not that of formation of a covalent bond through the cellulosic hydroxyls, such as for example a phosphorylation reaction, is indicated by the lack of bound phosphorus in the resulting chemically-modified cotton fabric. At most, only a trace of phosphorus remains in the rinsed or laundered chemically-modified cotton fabric. It is additionally pertinent that neutral or near-neutral salts such as lithium chloride sodium bromide, sodium fluoborate, sodium thiocyanate, etc. are either detrimental, in that they have an adverse effect upon the balance of textile properties, or without beneficial effect, such as noted from the presence of the phosphates. The operation of a physical effect from the phosphate salts is suggested by a small but significant increase in hydrophilic characteristic of the fibers or fabrics resulting from treatments involving these salts. The increase falls in the range of 20+% for moisture regain and 15+% for water imbibition. There is supplementary evidence from microscopic examination of fibers from crosslinking reactions involving the phosphate salts that these fibers are more or less abnormal in the extent to which they expand, but do not dissolve, in cellulosic solvents. Conventionally crosslinked cotton fibers at high levels of durable-press appearance rating and wrinkle recovery angle show little or no expansion when subjected to these same cellulosic salts. Similar difference is noted in the response of cotton fibers crosslinked with and without phosphate salts to the methacrylate-expansion test. Products of the present invention tend to exhibit more of the characteristics of the unmodified cotton fibers in these regards than would be expected and than is observed for the conventionally-crosslinked cotton fiber.

Supplementary components may be introduced into the reagent system for conventional purposes; such supplementary materials include wetting agents, softening agents, water soluble ion exchange resins, lubricant, soil-release agent, etc.

A specific example of a preferred embodiment of the reagent system is as follows:

FORMULA OF FINISHING BATH

| Chemical Component | Percentage by Weight |
|---|---|
| Polyfunctional N-methylol reagent | 3.00–20.00 |
| Acid or acid-generating agent | 0.25–4.00 |
| Phosphate salt or mixture of salts | 0.1–4.0 |
| Supplementary components | (ca. 0.5–4) |
| Water | to bring total to 100 |

The polyfunctional N-methylol reagent may be one or more of a number of conventional methylol crosslinking reagents used for finishing cellulosic fabrics. The preferred reagent is dimethyloldihydroxyethyleneurea, but other reagents which also may be used advantageously include methyloluron, methylolated carbamates, and methylated methylolmelamimes. The acid catalyst that is employed to facilitate reactions between the N-methylol reagent and cellulose is selected from among Brϕnsted acids, which are characterized by ability to provide a proton or hydronium ion in the reaction mixture. It is preferred that the catalyst be selected from among ammonium or metal bisulfates, or ammonium or metal persulfates, or inorganic acids derived from phorphorus. Where metal ions are involved it is preferred that they be low in atomic number and molecular weight. Salts of persulfuric acids do not conform to the definition of Brϕnsted acids until they have undergone thermal decomposition to bisulfate anions. Phosphate salts appropriate for this invention consist of the ammonium and alkali metal salts of various phosphoric and phorphorus acids primarily the mono and dihydrogen phosphate or phosphite salts. These salts may be employed in a specific chemical form, as for example, sodium dihydrogen phosphate or disodium monohydrogen phosphate, or they may be formed in the reaction mixture by partial neutralization of a phosphorus-derived acid. Thus, for combinations involving bisulfate and persulfate salts, it is preferred to employ ammonium or alkali metal salts of dihydrogen and dihydrogen phosphate. However, when the primary catalyst is phosphoric acid, it is preferred to neutralize a portion of this acid to convert it into ammonium or alkali metal phosphate to an extent appropriate for the purposes of this invention. Depending upon the specific situation, it may be desirable to introduce conventional agents that are employed in textile finishing for specific purposes; for example, small amounts of wetting agents are advantageous in most cases where speed of wetting is an important factor; softening agent, exemplified by emulsions of low molecular weight polyethylenes, are beneficial in the conventional manner of providing a pleasant hand to the fabric; soil release agents and antistatic agents are compatable with this system and may be introduced.

After the cellulosic textile is impregnated with the reagent solution, it may be stored in the wet state or subjected to immediate reaction. There is, in fact, improved stability by virtue of the introduction of phosphates into the reagent systems. The impregnated and dried textile may be cured immediately or may be stored before this cure. The curing step consists of a high temperature treatment carried out in an oven or in an apparatus which supplies a controlled amount of heat to the fabric. The curing step or steps may be conducted over a range of temperatures, between 100° and 200° C. and from times varying from a few seconds to many minutes, in inverse proportion to the temperature of the cure. The preferred curing conditions are those at temperatures in the range of 140°–200° C. for periods of 0.2–5 minutes. After the cure, the fabric may be stored in this stage or it may be converted into garments; the fabric may also be subjected to a process wash to remove small amounts of components which have not undergone fixation in the fibers.

TESTING METHODS EMPLOYED

The following textile testing methods were employed; durable-press appearance rating after one laundrying and tumble-drying cycle by AATCC test method 124–1967, conditioned and wet wrinkle recovery angles with the Monsanto tester by ASTM D1295-67, breaking strength and elongation by the strip (1 in.) method according to ASTM D1682-64, tearing strength by ASTM D1424-63, Stoll flex abrasion resistance by ASTM D1175-55T(b), and Accelerotor abrasion resistance by AATCC test method 93-1974.

The essence of the present invention is the discovery that, as a result of introducing selected phosphate salts into a reagent system involving conventional di-or polyfunctional N-methylol reagents in combination with selected Brϕnsted acid catalysts, that high levels of resilience can be achieved in the chemical modification of cotton and that improved levels of abrasion resistance and strength can be combined with these high levels of resilience in the chemically modified fabric. By controlling the amounts and proportions of the Brϕnsted acids and phosphate salts, especially attractive performance qualities of the chemically-modified cotton fabric can be achieved.

The following examples are provided to illustrate the preferred embodiments of the present invention. This is not meant to limit the scope of the invention in any manner whatever.

EXAMPLE 1

(This example is illustrative of the effects resulting from the use of phosphate salts in conjunction with ammonium, sodium, potassium, magnesium, and aluminum bisulfates. Each of these bisulfates provides a high degree of catalytic activity when employed as the sole catalyst component of the reaction. This high level of activity is detrimental to the retention of strength and abrasion resistance in the chemically-modified cotton fabric. Among the sodium, magnesium, and aluminum bisulfates, catalytic activities approach equivalence; however, the sodium salt is generally preferred on the basis of economics and ecology).

Cotton 80×80 print cloth was impregnated to about 100% wet pickup with a solution containing 8% of dimethyloldihydroxyethyleneurea (DMDHEU), 2.1% sodium bisulfate, 0.1% wetting agent, and 1.1% solids of polyethylene softener. Samples of fabrics were placed on pinframes, dried at 70° C. for 6 minutes, cured at 160° C. for 3 minutes, and subjected to laundering and tumble-drying. These samples were designated 1*a;* corresponding samples of fabrics treated with the same reagent bath containing 1.04% of each $KH_2PO_4$ and $Na_2HPO_4$ were designated 1*b;* samples from treatments involving 1.39% $Na_2HPO_4$ in this same reagent formulation were designated 1*c.* The original unmodified cotton was designated 1*d.* Results of these treatments are summarized in Table I, which shows that high levels of resilience are obtained in the absence of phosphate salts but these are accompanied by low levels of abrasion resistance and strength.

TABLE I

| NO. | DP Rating | WRA° Cond. | (W+ F) Wet | Stoll Flex Abrasion % Retained | Accelerotor Abrasion % Wt.Retained | Breaking Strength % Retained | Tearing Strength % Retained |
|---|---|---|---|---|---|---|---|
| 1a | 4.4 | 310 | 274 | 9.9 | 95.6 | 31.1 | 57.9 |
| 1b | 4.4 | 296 | 266 | 51.0 | 96.5 | 44.7 | 69.9 |
| 1c | 4.2 | 288 | 249 | 83.0 | 97.9 | 49.4 | 71.4 |
| 1d | 1.6 | 202 | 184 | 100 | 99.5 | 100 | 100 |

EXAMPLE 2

(This example illustrates the effectiveness of ammonium and metal persulfates in the present invention. Results described here are indicative of those obtained with ammonium, sodium, potassium, magnesium, and aluminum salts of persulfuric acid. Except for the ammonium persulfate, which is characterized by a pH of about 2–4, the metal persulfates show pH values near neutrality when they are dissolved in aqueous solution. However, in the presence of foreign agents or at temperatures above about 60°–80° C. these persulfates undergo decomposition with the generation of free radicals and ultimate formation of bisulfate anions).

Cotton 80×80 print cloth was treated with a solution containing 8% solids of a commercial DMHDEU sold under the trade name Fixapret CP-40, 0.60% ammonium persulfate, 0.1% wetting agent, and 1.1% solids of polyethylene softener. The process of treatment was that described in Example 1. The chemically-modified cotton resulting from treatment in the absence of phosphate salts is designated 2*a.* Products resulting from treatments conducted in the presence of phosphate salts were as follows: 2*b,* 0.26% $KH_2PO_4$; 2*c,* 0.26% of each $KH_2PO_4$ and $Na_2HPO_4$; 2*d,* 0.52% of each of the two phosphate salts; 2*e,* 1.04% of each of the phosphate salts; and 2*f,* 3.0% $Na_2HPO_4$. Results of textile test on these products are summarized in Table II, wherein the data show that a low concentration of phosphate salt caused an elevation in DP rating and increased abrasion resistance and strength; at moderate concentrations of phosphate salts there is small decrease in DP rating with large increases in abrasion resistance and strength; and at higher concentrations, DP rating drops off substantially while retention of strength and abrasion resistance continue to increase.

TABLE II

| NO, | DP Rating | WRA° Cond. | (W + F) Wet | Stoll Flex Abrasion % Retained | Accelerotor Abrasion % Wt. Retained | Breaking Strength % Retained | Tearing Strength % Retained |
|---|---|---|---|---|---|---|---|
| 2a | 4.6 | 297 | 261 | 6.9 | 67.9 | 41.4 | 55.1 |
| 2b | 4.7 | 293 | 259 | 21.1 | 84.1 | 45.4 | 61.8 |
| 2c | 4.8 | 294 | 259 | 37.4 | 87.3 | 50.2 | 65.4 |
| 2d | 4.7 | 290 | 246 | 45.1 | 92.3 | 54.5 | 68.4 |

TABLE II-continued

| NO, | DP Rating | WRA° Cond. | (W + F) Wet | Stoll Flex Abrasion % Retained | Accelerotor Abrasion % Wt. Retained | Breaking Strength % Retained | Tearing Strength % Retained |
|---|---|---|---|---|---|---|---|
| 2e | 4.0 | 281 | 245 | 101 | 95.1 | 57.9 | 87.0 |
| 2f | 3.6 | 269 | 225 | 222.8 | 95.5 | 57.4 | 91.1 |
| 2g | 1.5 | 212 | 193 | 100 | 98.7 | 100 | 100 |

EXAMPLE 3

(This example illustrates beneficial effects in chemically-modified cotton fabrics as a consequence of conducting the reaction in the presence of a phosphorus-derived acid in the presence of which some alkali metal phosphate has been formed by in situ partial neutralization of phosphoric acid, phosphorus acid or pyrophosphoric acid).

Cotton 80×80 print cloth was impregnated to about 100% wet pickup with a solution containing 8% DMDHEU, 0.75% phosphoric acid, 0.1% wetting agent and 1.1 solids of polyethylene softener. The fabric was placed on pinframes, dried at 70° C. for 6 minutes, cured at 160° C. for 3 minutes, laundered with detergent, and tumble dried. The chemically-modified cotton resulting from this treatment was designated *3a*. Products resulting from treatments of cotton fabric with reagents systems containing the alkali metal phosphates formed in situ were designated as follows: *3b*, 1.7 ml of 1.02 M MaOH; *3c*, 4.0 ml of the same base; *3d*, 5.0 ml of the base; *3e*, 5.50 ml base; *3f*, the unmodified cotton fabric. Results are summarized in Table III, which shows substantial increases in abrasion resistance and strength with increasing degree of formation of alkali metal phosphate in the catalyst system.

TABLE III

| NO. | DP Rating | WRA° Cond. | (W + F) Wet | Stoll Flex Abrasion % Retained | Accelerotor Abrasion % Wt. Retained | Breaking Strength % Retained | Tearing Strength % Retained |
|---|---|---|---|---|---|---|---|
| 3a | 4.9 | 298 | 276 | 11.9 | 86.4 | 41.2 | 67.7 |
| 3b | 4.7 | 297 | 273 | 21.9 | 92.0 | 42.6 | 57.9 |
| 3c | 4.4 | 290 | 263 | 61.5 | 90.6 | 52.7 | 75.2 |
| 3d | 4.3 | 289 | 262 | 125.2 | 93.6 | 58.3 | 83.2 |
| 3e | 4.1 | 289 | 261 | 109.6 | 99.1 | 56.2 | 82.5 |
| 3f | 1.6 | 191 | 180 | 100 | 99.5 | 100 | 100 |

EXAMPLE 4

(This example pertains to the effectiveness of catalyst systems containing phosphate salts for the chemical finishing of cotton with a variety of di-and polyfunctional N-methyol reagents).

The effect of phosphate salts on the chemical finishing reaction and the quality of chemically-modified cotton resulting from the chemical finishing reaction catalyzed with the acidic agents described in examples 1-3 is similar to those already illustrated when the DMDHEU in the foregoing examples is replaced with the following N-methyol reagents: dimethylolethyleneurea, dimethylolmethylcarbamate, bis(methoxymethyuron), methylated methylolamine, methylated urea-formaldehyde, an dimethylolethyltriazone. In all of these cases and in the case of DMDHEU the solids contents of the reagents may be varied over a broad range but is most commonly employed in the range of 5-12%. Urea-formaldehyde reagent and trimethlolmelamine are quite sensitive to the catalyst system in the absence of phosphate salts; polymerization occurs due to the relatively low pH values of these solutions (e.g., pH=about 1.9 for bisulfates; =3-7 for persulfates; =2.0 for phosphorus-derived acids.) However, all of these reagents are stable in the presence of the catalyst systems containing phosphate salts, which effectively catalyze the reactions with cotton. In the case of formaldehyde as the crosslinking reagent, significant beneficial effects, as illustrated above, have not been realized.

We claim:

1. A chemical composition for imparting to cellulosic textiles improved balances of physical properties, including resilience, strength, abrasion resistance and hydrophilicity, the composition comprising an aqueous solution containing about 3% to 20% of N-methylol reagent selected from the group consisting of:

dimethyloldihydroxyethyleneurea,
dimethylolethyleneurea,
methylolated alkyl carbamates,
methylated methylolmelamines, and
dimethylol alkyltriazones;

about from 0.25 to 4.0% of a Brϕnsted acid or acid-generating catalyst selected from the group consisting of:

an ammonium, sodium, or potassium bisulfate,
a magnesium or aluminum bisulfate,
an ammonium, sodium, or potassium persulfate, and
a phosphoric, pyrophosphoric, or phosphorus acid; and a phosphate salt or mixture of salts selected from the group consisting of:

ammonium, sodium, potassium monohydrogen and dihydrogen phosphates.

* * * * *